US011201025B2

(12) United States Patent
Wardle et al.

(10) Patent No.: US 11,201,025 B2
(45) Date of Patent: Dec. 14, 2021

(54) SYSTEMS AND METHODS FOR AN ELECTROMAGNETIC ACTUATOR

(71) Applicant: HUSCO AUTOMOTIVE HOLDINGS INC., Waukesha, WI (US)

(72) Inventors: Dean Wardle, Oconomowoc, WI (US); Michael Fricke, New Berlin, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 210 days.

(21) Appl. No.: 16/393,060

(22) Filed: Apr. 24, 2019

(65) Prior Publication Data

US 2019/0252144 A1 Aug. 15, 2019

Related U.S. Application Data

(63) Continuation of application No. 15/346,459, filed on Nov. 8, 2016, now Pat. No. 10,319,549.

(Continued)

(51) Int. Cl.
*H01F 7/00* (2006.01)
*H01H 51/06* (2006.01)

(Continued)

(52) U.S. Cl.
CPC ..... *H01H 51/06* (2013.01); *H01F 7/1615* (2013.01); *H01H 45/04* (2013.01); *H01H 47/22* (2013.01);

(Continued)

(58) Field of Classification Search
CPC ..... H01H 51/06; H01H 47/22; H01H 45/04; H01H 2235/01; H01F 7/1615; H01F 2007/086; H01F 2007/163

(Continued)

(56) References Cited

U.S. PATENT DOCUMENTS 4,046,244 A 9/1977 Velazquez
4,072,918 A 2/1978 Read, Jr.

(Continued)

FOREIGN PATENT DOCUMENTS

CN 2577419 Y 10/2003
DE 10240774 A1 4/2003

(Continued)

OTHER PUBLICATIONS

European Patent Office, Extended European Search Report, Application No. 16197799.6, dated Mar. 23, 2017, 9 pages.

(Continued)

*Primary Examiner* — Shawki S Ismail
*Assistant Examiner* — Lisa N Homza
(74) *Attorney, Agent, or Firm* — Quarles & Brady LLP

(57) ABSTRACT

An electromagnetic actuator having a permanent magnet coupled to an armature of the electromagnetic actuator is provided. The electromagnetic actuator includes a housing, and an armature assembly arranged within the housing. The armature assembly includes an armature and a permanent magnet coupled to the armature. The armature is movable between a first position and a second position, and the permanent magnet defines an axial magnet thickness and the armature defines an axial armature thickness. A ratio of the axial armature thickness to the axial magnet thickness is greater than approximately three.

20 Claims, 10 Drawing Sheets

Related U.S. Application Data

(60) Provisional application No. 62/309,505, filed on Mar. 17, 2016.

(51) Int. Cl.
*H01F 7/16* (2006.01)
*H01H 45/04* (2006.01)
*H01H 47/22* (2006.01)
*H01F 7/08* (2006.01)

(52) U.S. Cl.
CPC .. *H01F 2007/086* (2013.01); *H01F 2007/163* (2013.01); *H01H 2235/01* (2013.01)

(58) Field of Classification Search
USPC ..... 335/229
See application file for complete search history.

(56) References Cited

U.S. PATENT DOCUMENTS 4,783,051 A * 11/1988 Gibas ..... F16K 31/0655 251/129.19
4,928,028 A 5/1990 Leibovich
4,994,776 A 2/1991 Juncu
5,010,911 A 4/1991 Grant
5,161,779 A 11/1992 Graner et al.
5,272,458 A 12/1993 Hoffman et al.
5,547,165 A 8/1996 Brehm et al.
5,611,370 A 3/1997 Najmolholda
6,040,752 A 3/2000 Fisher
6,198,369 B1 3/2001 Ward et al.
6,414,577 B1 7/2002 Hoffman
6,639,496 B1 10/2003 van Namen
6,729,277 B2 5/2004 Yamaki et al.
6,950,000 B1 9/2005 Lanni et al.
6,967,550 B2 11/2005 Elendt et al.
7,097,150 B2 8/2006 Sedda et al.
7,219,698 B2 5/2007 Mayer
8,176,887 B2 5/2012 Golz et al.
8,203,405 B2 6/2012 Golz et al.
2005/0052265 A1 3/2005 Vladimirescu et al.
2005/0230649 A1 10/2005 Scheibe
2007/0035371 A1 2/2007 Yamasaki et al.
2007/0194872 A1 8/2007 Pfister et al.
2008/0079521 A1 4/2008 Maerky et al.
2008/0204175 A1 8/2008 Barabas-Lammert
2008/0245983 A1* 10/2008 Hoppe ..... H01F 7/1607 251/65
2008/0276889 A1 11/2008 Sfaxi et al.
2009/0200502 A1* 8/2009 Hoppe ..... H01F 7/128 251/129.15
2010/0025606 A1* 2/2010 Hoppe ..... H01F 7/128 251/129.15
2010/0163128 A1* 7/2010 Kinscher ..... F16K 27/048 137/625.64
2010/0271157 A1 10/2010 Talon
2011/0001591 A1 1/2011 Puth et al.
2011/0084018 A1* 4/2011 Hoppe ..... B01D 29/111 210/495
2011/0121218 A1* 5/2011 Hoppe ..... H01F 7/081 251/129.15
2011/0204269 A1* 8/2011 Hoppe ..... F16K 31/061 251/129.01
2011/0220826 A1* 9/2011 Hoppe ..... F01L 1/3442 251/129.15
2011/0248804 A1* 10/2011 Wygnanski ..... H01F 7/1646 335/230
2011/0285484 A1* 11/2011 Hoppe ..... H01F 7/081 335/229
2012/0312262 A1* 12/2012 Hoppe ..... F01L 1/3442 123/90.17
2015/0322830 A1* 11/2015 Rigling ..... F01L 13/0036 123/90.11

FOREIGN PATENT DOCUMENTS

DE 102009006061 A1 7/2010
DE 102013206976 A1 10/2014
EP 0380693 A1 8/1990
EP 2993674 A1 3/2016
GB 2243488 A 10/1991
JP S4947873 5/1974
JP S59170581 9/1984
JP H01302707 A 12/1989
JP 2003148647 A 5/2003
JP H10-127033 A 3/2006
JP 2011204703 A 10/2011
JP 2015-056999 A 3/2015
JP 2015223072 A 12/2015
WO 2008012179 A2 1/2008

OTHER PUBLICATIONS

European Patent Office, Examination Report, Application No. 16197799.6, dated Jul. 11, 2019, 7 pages.
European Patent Office, Extended European Search Report, Application No. 16197805.1, dated Jun. 13, 2017, 12 pages.

* cited by examiner

SYSTEMS AND METHODS FOR AN ELECTROMAGNETIC ACTUATOR

CROSS-REFERENCES TO RELATED APPLICATIONS

This application is a continuation of U.S. application Ser. No. 15/346,459 filed on Nov. 8, 2016, which claims priority to U.S. Provisional Patent Application No. 62/309,505, filed Mar. 17, 2016, the disclosures of which are both incorporated by reference here in their entirety.

STATEMENT REGARDING FEDERALLY SPONSORED RESEARCH

Not Applicable.

BACKGROUND

Electromagnetic actuators (e.g., a variable force solenoid) typically include a wire coil positioned within a housing and around a moveable armature. A current can be applied to the wire coil to produce a magnetic field which can then actuate (i.e., move) the moveable armature with respect to the housing. Current trends are leading towards improving the output force and efficiency of electromagnetic actuators; however, this requires decreasing magnetic losses by, for example, reducing air gaps within the electromagnetic actuators. This reduction in the air gaps within an electromagnetic actuator can result in increasingly higher starting flux (e.g. pin fully retracted into solenoid housing), as the reluctance of the magnetic circuit can be lower under all operating conditions. The higher starting flux, as a result of the reduction in the air gaps, can require the parts (e.g., housing, armatures, etc.) that carry the flux to require more area (e.g., increased thickness, larger diameters, etc.) to prevent magnetic saturation. Increasing the area of the flux carrying components can lead to added cost due to additional material, and also require more space, which offsets a desirable outcome of making the electromagnetic actuator smaller.

Additionally, a reduction in air gaps can extremely tighten the tolerances and clearances, which, for manufacturing purposes, can prohibitively increase costs. Furthermore, a reduction in the air gaps can lead to high side loading forces (i.e., forces substantially perpendicular to the desired direction of actuation) if the armature is not kept fully centered.

SUMMARY OF THE INVENTION

The present disclosure relates generally to electromagnetic actuators and, more specifically, to a variable force solenoid having a permanent magnet.

The present invention provides an electromagnetic actuator having a permanent magnet coupled to an armature of the electromagnetic actuator. The permanent magnet can provide a reduced magnetic flux throughout the electromagnetic actuator thereby enabling the electromagnetic actuator to utilize smaller flux carrying components. The permanent magnet also can act as an output force booster (i.e., increasing an output force of the electromagnetic actuator when compared to an electromagnetic actuator without a permanent magnet) enabling the electromagnetic actuator to utilize less amp-turns (i.e., less copper windings in the wire coil) to achieve similar performance (as an electromagnetic actuator without a permanent magnet).

In one aspect, the present invention provides an electromagnetic actuator including a housing, a pole piece arranged within the housing and secured by an end plate, and an armature assembly having an armature and a permanent magnet coupled to the armature. The armature is movable between a first position and a second position. The electromagnetic actuator further includes a wire coil positioned around the armature assembly and arranged within the housing. An actuation position of the armature between the first position and the second position is proportional to a magnitude of current applied to the wire coil.

In one aspect, the present invention provides an electromagnetic actuator including a housing, and an armature assembly arranged within the housing. The armature assembly includes an armature and a permanent magnet coupled to the armature. The armature is movable between a first position and a second position, and the permanent magnet defines an axial magnet thickness and the armature defines an axial armature thickness. A ratio of the axial armature thickness to the axial magnet thickness is greater than approximately three.

In one aspect, the present invention provides an electromagnetic actuator including a housing, and an armature assembly arranged within the housing. The armature assembly includes an armature and a permanent magnet coupled to the armature. The armature is movable between a first position and a second position, and the armature defines an armature volume and the permanent magnet defines a permanent magnet volume. A ratio of the armature volume to the permanent magnet volume is greater than approximately three.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings

DETAILED DESCRIPTION OF THE INVENTION

Figure 1:
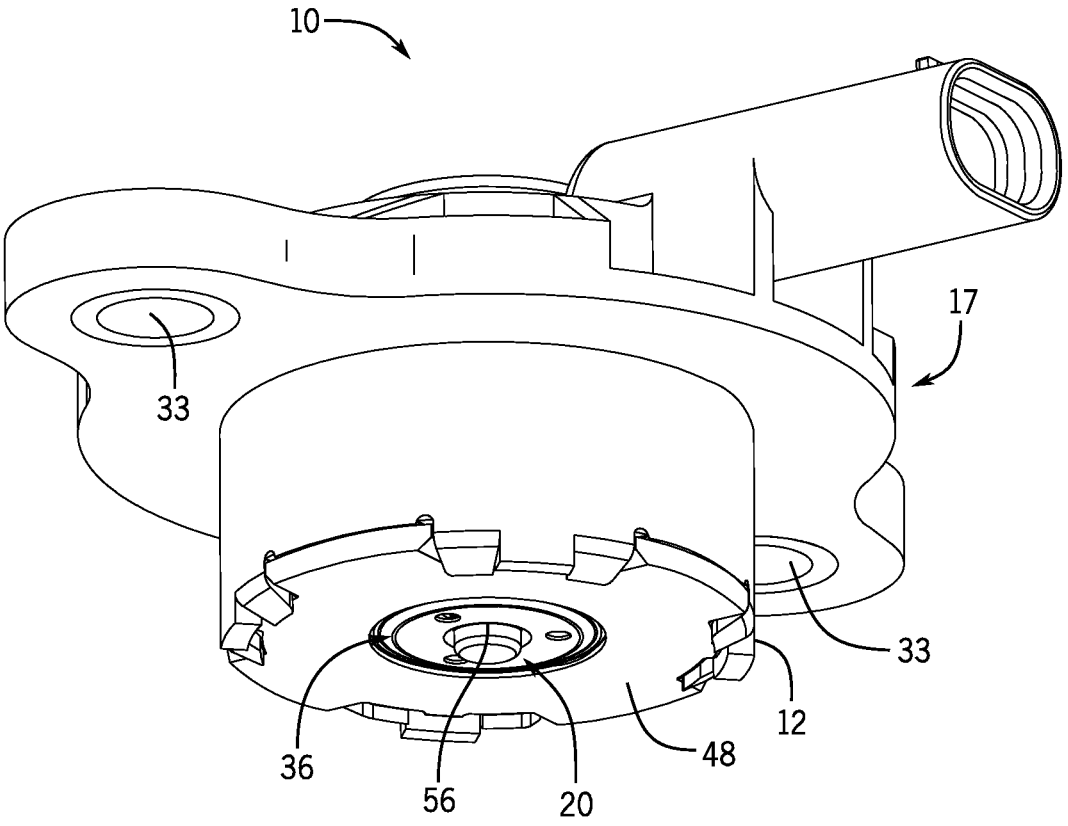
FIG. 1 is a bottom, front, left isometric view of an electromagnetic actuator according to one embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

The use of the phrase "between a first position and a second position" and variations thereof herein does not imply directionality and may include, for example, movement from the first position to the second position and movement from the second position to the first position. Additionally, the phrase "between a first position and a second position" and variations thereof does not imply discreteness and may encompass, for example, movement from the first position to the second position and/or movement from the second position to the first position and all positions therebetween.

Figure 2:
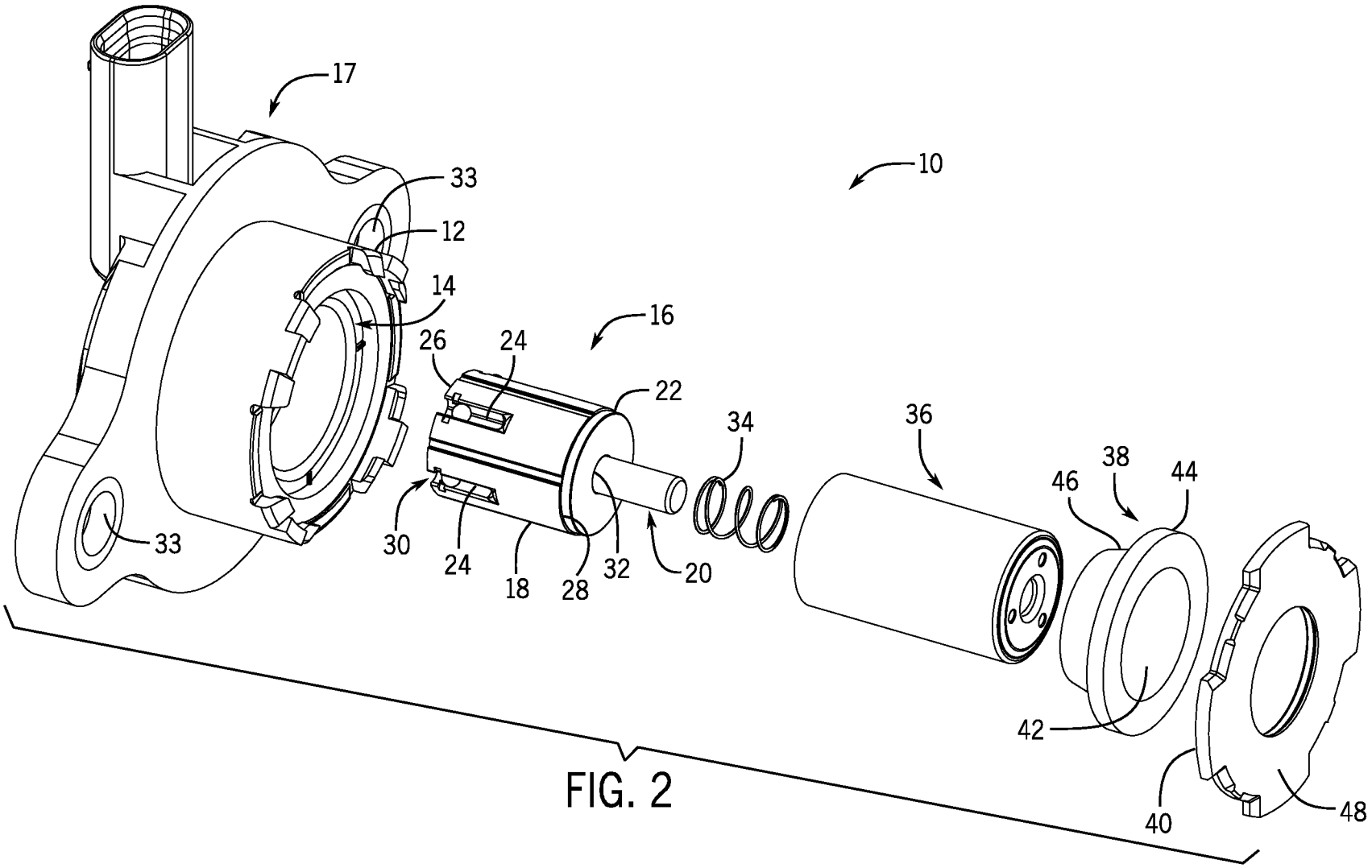
FIG. 2 is an exploded left, front, bottom isometric view of the electromagnetic actuator of FIG. 1.

FIG. 1 shows an electromagnetic actuator 10 in accordance with one embodiment of the present invention. In some non-limiting examples, the electromagnetic actuator 10 may be a variable force solenoid. As shown in FIGS. 1 and 2, the electromagnetic actuator 10 can include a housing 12 configured to receive a bobbin 14 and an armature assembly 16. The housing 12 can be fabricated from a magnetic material (e.g., a magnetic steel, iron, nickel, etc.) and can define a generally cylindrical shape. In other embodiments, the housing 12 can define a different shape, for example a rectangular shape, as desired. The housing 12 can be partially received within an overmold 17. The bobbin 14 can be fabricated from a non-magnetic material (e.g., plastic).

The armature assembly 16 can include an armature 18, a push pin 20, and a permanent magnet 22. The armature 18 can be fabricated from a magnetic material (e.g., a magnetic steel, iron, nickel, etc.) and can define a generally cylindrical shape. The armature 18 can include a plurality of bearing slots 24 arranged circumferentially around a periphery of the armature 18. The plurality of bearing slots 24 can each define a radial recess in the armature that extend axially from a first end 26 of the armature 18 to a position between the first end and a second end 28 of the armature 18. Each of the plurality of bearing slots 24 are configured to receive a corresponding bearing 30 therein to reduce friction during actuation of the armature 18.

The push pin 20 can be coupled to the armature 18 for actuation therewith, and can protrude from the second end 28 of the armature 18. The permanent magnet 22 defines a generally annular shape and includes a central aperture 32 from which the push pin 20 can protrude. It should be known that, in other embodiments, the permanent magnet 22 may not include the central aperture 32. The permanent magnet 22 can be coupled to the second end 28 of the armature 18 for actuation therewith. In some embodiments, the permanent magnet 22 can be attached to the second end 28 of the armature 18 by, for example, an adhesive. In other embodiments, the permanent magnet 22 can be removably coupled to the second end 28 of the armature 18, for example, by the magnetic attraction between the permanent magnet 22 and the armature 18. In still other embodiments, the permanent magnet 22 may not be coupled to the second end 28 of the armature 18 and instead integrated into the armature 18 adjacent to the second end 28.

The overmold 17 can be fabricated from a non-magnetic material (e.g., plastic) and can include a pair of opposing mounting apertures 33. The pair of opposing mounting apertures 33 can be configured to receive a mounting element (not shown) for securing the electromagnetic actuator 10 to a surface during installation.

With continued reference to FIG. 2, the electromagnetic actuator 10 can include a spring 34, a solenoid tube 36, a pole piece 38, and an end plate 40. The spring 34 can be arranged between the armature 18 and the solenoid tube 36 and can be configured to retract the armature 18 and thereby the push pin 20 from an extended or actuated position. It should be known that, in some installations, the push pin 20 may be automatically retracted from an extended or actuated position (e.g., via an external forcing function). In these installations, the spring 34 may not be included in the electromagnetic actuator 10.

The solenoid tube 36 can be fabricated from a magnetic material (e.g., a magnetic steel, iron, nickel, etc.) and can define a generally cylindrical shape. The solenoid tube 36 can be configured to receive the armature assembly 16. The pole piece 38 can be fabricated from a magnetic material (e.g., a magnetic steel, iron, nickel, etc.) and can define a generally annular shape. The pole piece 38 can include a pole aperture 42, a flange portion 44, and a tapered surface 46. The pole aperture 42 can be dimensioned to receive the solenoid tube 36. The flange portion 44 can extend radially outward and the tapered surface 46 can extend axially from the flange portion 44 in a direction away from the end plate 40. The end plate 40 can be configured to secure the bobbin 14 and the pole piece 38 within the housing 12. The end plate 40 can be fabricated from a magnetic material (e.g., a magnetic steel, iron, nickel, etc.) and can define a generally annular shape. The end plate 40 can include a plate aperture 48 dimensioned to receive the solenoid tube 36.

Figure 3:
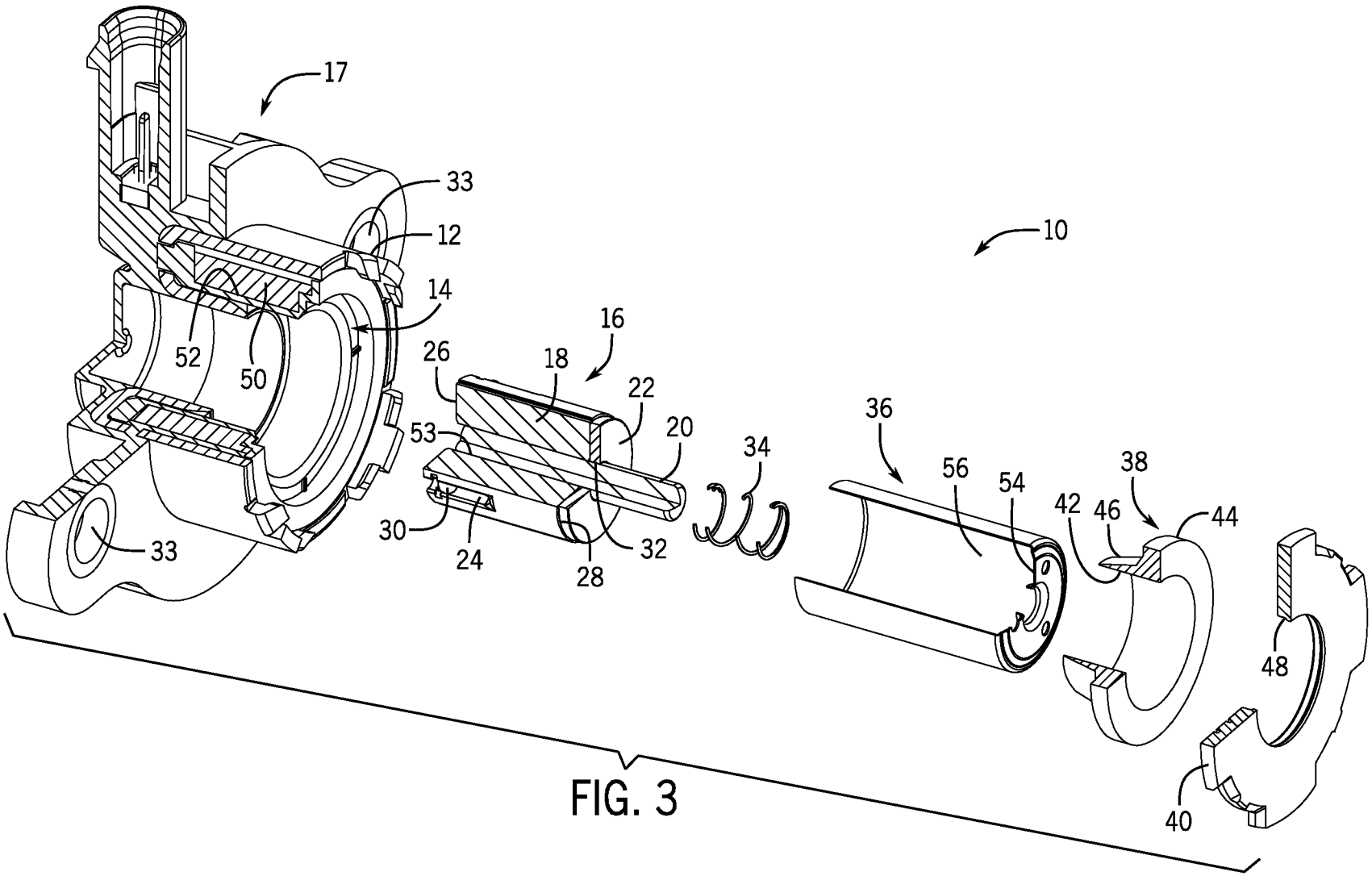
FIG. 3 is an exploded left, front, bottom isometric view of the electrometric actuator of FIG. 1 with a partial cross-section extracted.

Turning to FIG. 3, the electromagnetic actuator 10 can include a wire coil 50 arranged within the housing 12. The bobbin 14 can define a coil recess 52 dimensioned to position the wire coil 50 within the housing 12 such that, when assembled, the wire coil 50 extends around the armature assembly 16. The wire coil 50 can be fabricated, for example, from a copper coil that can be configured to produce a magnetic field, and thereby apply a force, in response to a current being applied to the wire coil 50. The direction and magnitude of the magnetic field, and the force, produced by the wire coil 50 can be determined by the direction and magnitude of the current applied to the wire coil 50.

The armature 18 can define a central aperture 53 that extends longitudinally through the armature 18 from the first end 26 to the second end 28. The push pin 20 can be received within the central aperture 53 of the armature 18 thereby coupling the push pin 20 to the armature 18. The armature platform 54 extends radially inward at an end of the solenoid tube 36 adjacent to the pole piece 38. The armature platform 54 defines a pin aperture 56 through which the push pin 20 can extend and retract during operation of the electromagnetic actuator 10.

When the electromagnetic actuator 10 is assembled, as shown in FIG. 3, the armature assembly 16 can be slidably received within the solenoid tube 36. The solenoid tube 36 and armature assembly 16 can be secured within a housing bore 58 of the housing 12 and surrounded by the wire coil 50. The wire coil 50 can be secured within the housing 12 by the bobbin 14, and the pole piece 38 can be secured around the solenoid tube 36 adjacent to the armature platform 54 by the bobbin 14 and the end plate 40. With the pole piece 38 secured around the solenoid tube 36, the tapered surface 46 tapers as it extends from the flange portion 44 in a direction away from the end plate 40.

Figure 4:
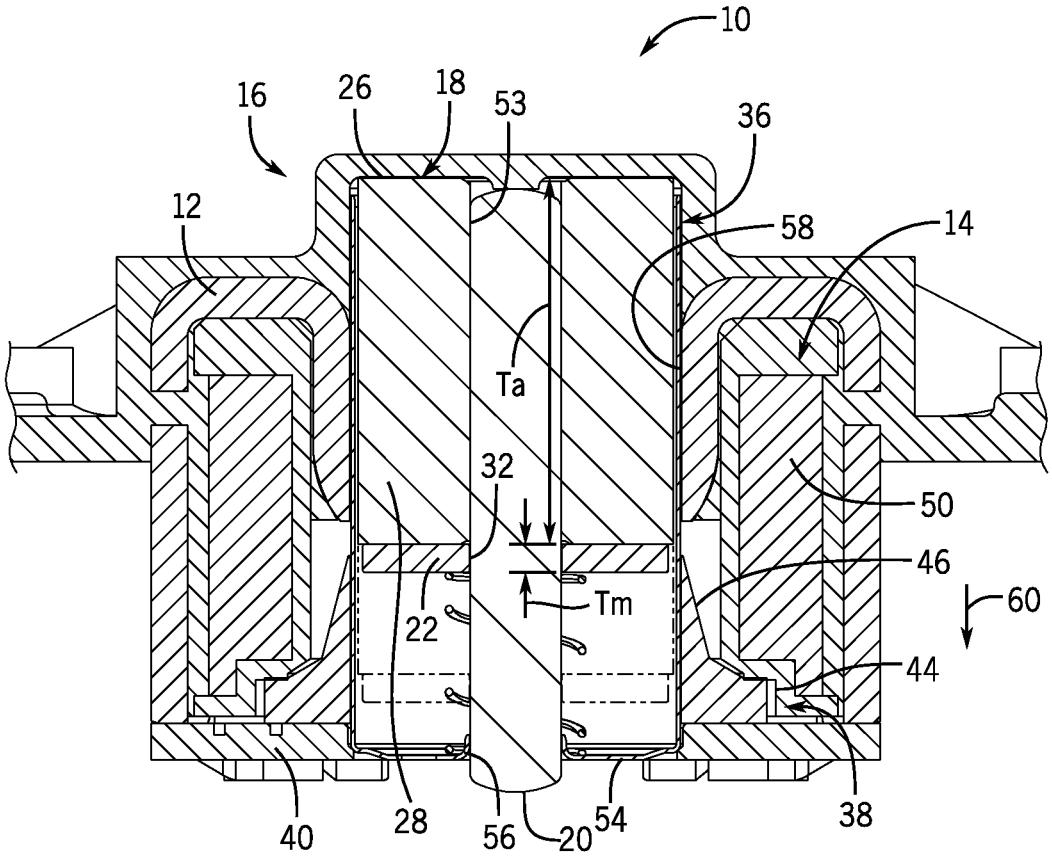
FIG. 4 is a cross-sectional view of the electromagnetic actuator of FIG. 1 taken along line 4-4.

As best shown in FIG. 4, the armature 18 and the permanent magnet 22 can be concentric (i.e., share a common longitudinal axis defined by the armature 18). The armature 18 can define an armature thickness $T_a$ and an armature volume $V_A$. Similarly, the permanent magnet 22 can define a magnet thickness $T_m$ and a magnet volume $V_m$.

In operation, the electromagnetic actuator 10 can be in communication with a controller (not shown) that can be configured to apply a current at a desired magnitude and in a desired direction to the wire coil 50. The armature 18, and thereby the permanent magnet 22 and the push pin 20, can be moveable between a first position (solid line) and a second position (dashed lines) in response to a current being applied to the wire coil 50. That is, the magnetic field produced by applying a current to the wire coil 50 can force the armature 18 between the first position and the second position. The actuation of the armature 18 between the first position and the second position can generate an output force (i.e., a force acting on the armature 18, and thereby the push pin 20, in a downward direction 60), for example, that is exerted by the push pin 20.

Figure 5:
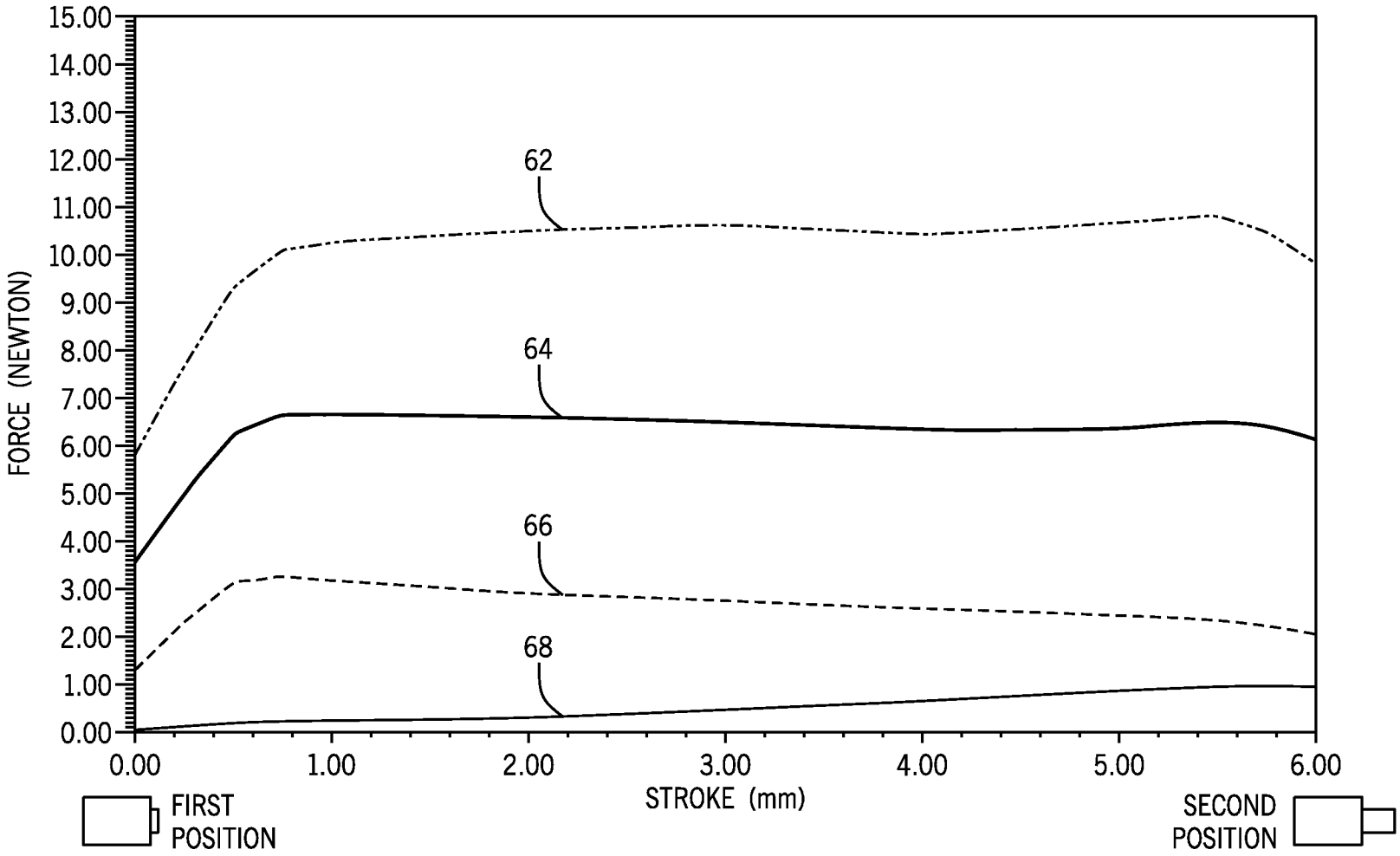
FIG. 5 is a graph illustrating an output force acting on an armature of the electromagnetic actuator of FIG. 1 as a function of position, or stroke, of the armature at varying magnitudes of current according to one embodiment of the present invention.

The construction of the electromagnetic actuator 10 can enable the armature 18 to be proportionally actuated with respect to the magnitude of the current applied to the wire coil 50. FIG. 5 illustrates a graph of the output force acting on the armature 18 in the downward direction 60 as a function of position (stroke) of the armature 18 at varying magnitudes of current applied to the wire coil 50. Specifically, the graph of FIG. 4 includes four lines 62, 64, 66, and 68 each representing the output force acting on the armature 18 in the downward direction 60 when a different magnitude of current is applied to the wire coil 50. Line 62 can represent no current applied to the wire coil 50, lines 64 and 66 can represent intermediate currents, with line 66 representing a greater current than line 64, applied to the wire coil 50, and line 68 can represent a high level of current applied to the wire coil 50.

As shown in FIG. 5, the output force on the armature 18 in the downward direction 60 can increase as the magnitude of the current applied to the wire coil 50 increases (i.e., line 68 is greater in magnitude than lines 66, line 66 is greater in magnitude than line 64, and so on). Additionally, each of the lines 62, 64, 66, and 68 define a generally flat, or generally constant, output force on the armature 18 in the downward direction 60 with respect to the position (stroke) of the armature 18. The generally flat output force profiles defined by lines 62, 64, 66, and 68 can correlate with the proportionality in the actuation of the armature 18 with respect to the magnitude of current applied to the wire coil 50. In other words, the magnitude of current applied to the wire coil 50 can determine a position of the armature 18 between the first position and the second position.

Figure 6:
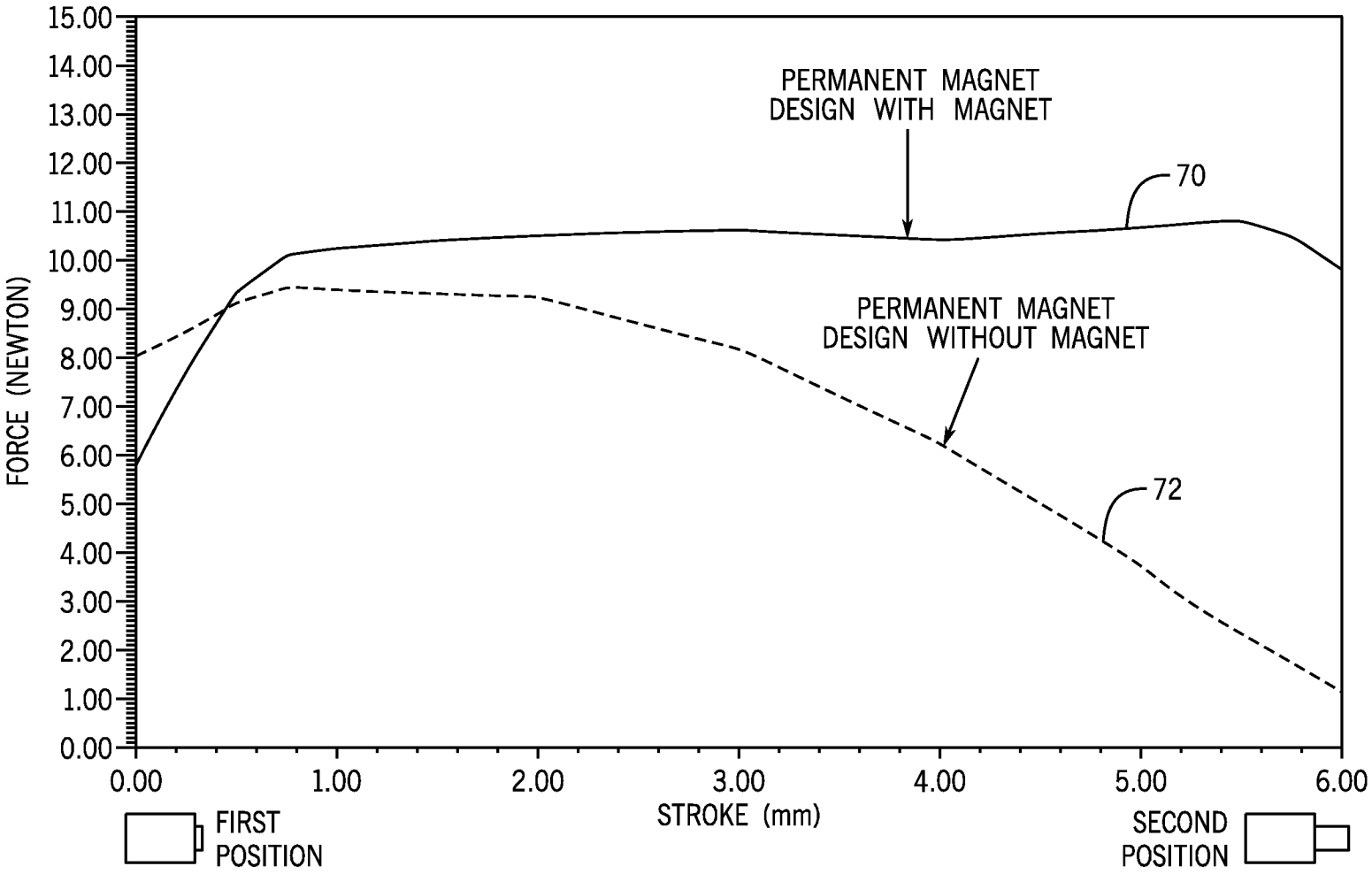
FIG. 6 is a graph illustrating an output force of the electromagnetic actuator of FIG. 1 and an electromagnetic actuator without a permanent magnet as a function of position, or stroke, according to one embodiment of the present invention.
Figure 7:
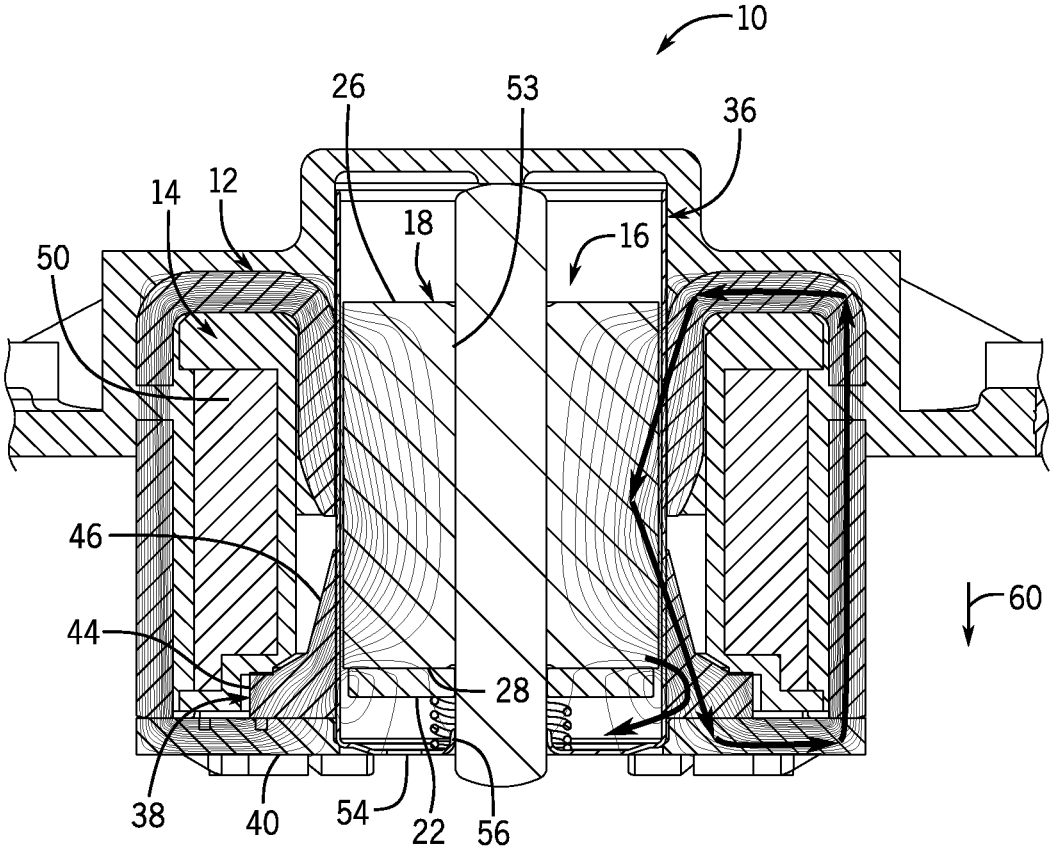
FIG. 7 illustrates a magnetic flux of the electromagnetic actuator of FIG. 1 when a high current is applied to a wire coil of the electromagnetic actuator.

In addition to the proportionality in the actuation of the armature 18 achieved by the electromagnetic actuator 10, the use of the permanent magnet 22 attached to the armature 18 can enable the electromagnetic actuator 10 to provide an increased output force when compared to an electromagnetic actuator without the permanent magnet 22. This increased output force can be illustrated in the graph of FIG. 6, which shows a relationship between the output force and position (stroke) for the electromagnetic actuator 10 (i.e., the output force on the armature 18 with the permanent magnet 22) and an electromagnetic actuator without the permanent magnet 22. Specifically, the graph of FIG. 6 includes line 70 that can represent the output force of the electromagnetic actuator 10 with a high current applied to the wire coil 50 and line 72 that can represent the output force of an electromagnetic actuator without the permanent magnet 22 with the same high current applied to a wire coil. As shown in FIG. 6, the magnitude of line 70 is substantially greater than the magnitude of the line 72 over generally the entire actuation range between the first position and the second position. The increased output force is especially prominent towards the end of the actuation range (i.e., adjacent to the second position) where the magnitude of the line 70 can be approximately a factor of 10 greater than the line 72. Clearly, the permanent magnet 22 provides the electromagnetic actuator 10 with an increased output force. This can enable the wire coil 50 the electromagnetic actuator 10 to have less amp-turns (i.e., less copper windings in the wire coil 50) to achieve similar performance as the electromagnetic actuator without the permanent magnet 22. Thus, to achieve similar performance, the electromagnetic actuator 10 can require less copper, reducing costs, and can be smaller in size. The permanent magnet 22 can also induce a varying magnetic flux through the magnetic components of the electromagnetic actuator 10 as current is applied to the wire coil 50. When a high current is applied to the wire coil 50 and the armature 18 is in the second position, as shown in FIG. 7, the magnetic flux generated by the wire coil 50 can be partially cancelled by magnetic flux generated by the permanent magnet 22. In particular, the magnetic flux generated by the wire coil 50 can define a flux path that travels through the armature 18 into the pole piece 38 and then around the end plate 40 and the housing 12. This path generated by the wire coil 50 can be cancelled by the magnetic flux generated by the permanent magnet 22 which can define a flux path that originates from the permanent magnet 22 and travels in an opposite direction when compared to the direction of the flux path defined by the wire coil 50.

The cancelling of the magnetic flux from the wire coil 50 provided by the permanent magnet 22 can result in a decreased magnetic saturation in all magnetic components of the electromagnetic actuator 10. That is, the permanent magnet 22 can act to prevent magnetic saturation in the magnetic components of the electromagnetic actuator 10, which can enable use of smaller/thinner/lighter magnetic components (e.g., the housing 12, the end plate 40, the pole piece 38, etc.).

Figure 8:
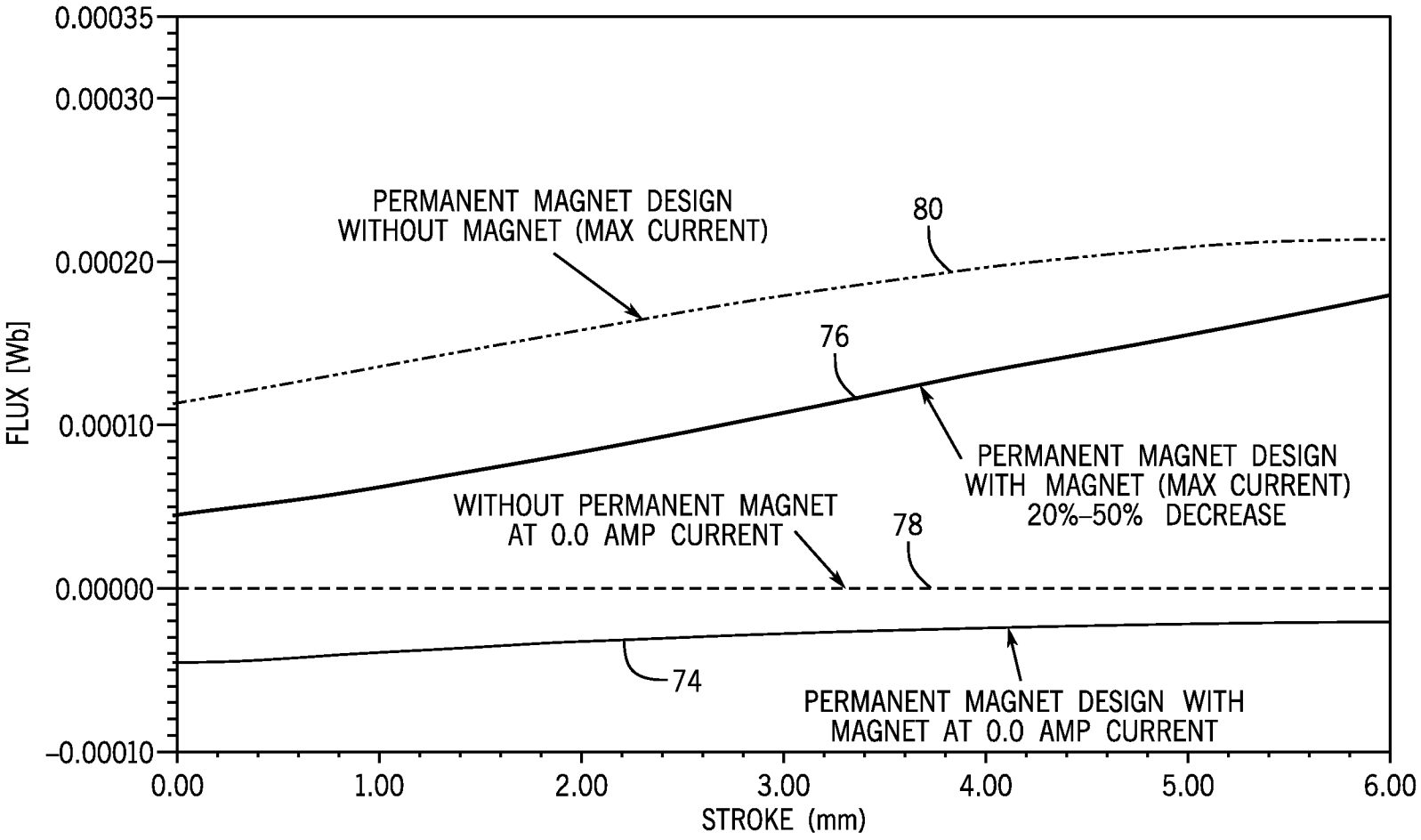
FIG. 8 is a graph illustrating a magnetic flux of the electromagnetic actuator of FIG. 1 and an electromagnetic actuator without a permanent magnet as a function of position, or stroke, at varying magnitudes of current according to one embodiment of the present invention.

The reduced magnetic flux levels provided by use of the permanent magnet 22 in the electromagnetic actuator 10 can be further illustrated in FIG. 8. FIG. 8 illustrates a magnetic flux as a function of position, or stroke, for the electromagnetic actuator 10 and an electromagnetic actuator without the permanent magnet 22 at varying magnitudes of current. Specifically, the graph of FIG. 8 can include lines 74 and 76 which can represent the magnetic flux through the electromagnetic actuator 10, and lines 78 and 80 which can represent the magnetic flux through an electromagnetic actuator without the permanent magnet 22. Line 74 can represent no current applied to the wire coil 50, and line 76 can represent a high current applied to the wire coil 50. Line 78 can represent no current applied to a wire coil, and line 80 can represent the same high current applied to a wire coil of the electromagnetic actuator without the permanent magnet 22.

As shown in FIG. 8, the permanent magnet 22 can induce a negative magnetic flux in the electromagnetic actuator 10 when no current is applied to the wire coil 50, as illustrated by line 74. Additionally, the cancellation of the magnetic flux produced by the wire coil 50 by the permanent magnet 22, described above, can be illustrated by the substantially reduced magnetic flux levels, over the entire actuation range between the first position and the second position, produced by the electromagnetic actuator 10 (line 76) compared to an electromagnetic actuator without the permanent magnet 22 (line 80). Thus, the use of the permanent magnet 22 enables the electromagnetic actuator 10 to provide reduced magnetic flux levels over the entire range of currents and the entire actuation range.

The reduced flux levels provided by the permanent magnet 22 of the electromagnetic actuator 10 can be achieved by proper geometric design of the armature 18 and the permanent magnet 22. That is, the specific geometric ratios, described below, can enable the electromagnetic actuator 10 to achieve the improved performance characteristics and, if the design of the falls outside of these ratios, it may have a negative effect on performance. The reduced flux levels can be governed by the geometric relationship between the armature thickness $T_a$, the armature volume $V_a$, the magnet thickness $T_m$, and the magnet volume $V_m$. That is, a thickness ratio $R_t$ can be defined as a ratio of the armature thickness $T_a$ to the magnet thickness $T_m$, and a volume ratio $R_v$ can be defined as a ratio of the armature volume $V_a$ to the magnet volume $V_m$. In some embodiments, the thickness ratio $R_t$ can be greater than approximately three, and the volume ratio $R_v$ can be greater than approximately three. In other embodiments, the thickness ratio $R_t$ can be between approximately 8 and 18, and the volume ratio $R_v$ can be between approximately 8 and 18. In still other embodiments, the thickness ratio $R_t$ can be between approximately 10 and 15, and the volume ratio $R_v$ can be between approximately 10 and 15.

The electromagnetic actuator 10, described above, can provide an output force at the push pin 20 in the downward direction 60. In other words, the electromagnetic actuator 10 can be a push actuator, where the push pin 20 can be configured to provide an output force in a pushing, or downward, direction 60. It should be appreciated that the electromagnetic actuator 10 may be configured to be a pull actuator. That is, in some non-limiting examples, the electromagnetic actuator 10 may be configured to provide an output force on the push pin 20 in an upward direction 100. In this non-limiting example, the armature 18 and thereby the push pin 20 may be moveable between a first position (solid line) and a second position (dashed line). As the armature 18 and thereby the push pin 20 moves between the first position and the second position, the push pin 20 may retract into the housing 12.

Figure 9:
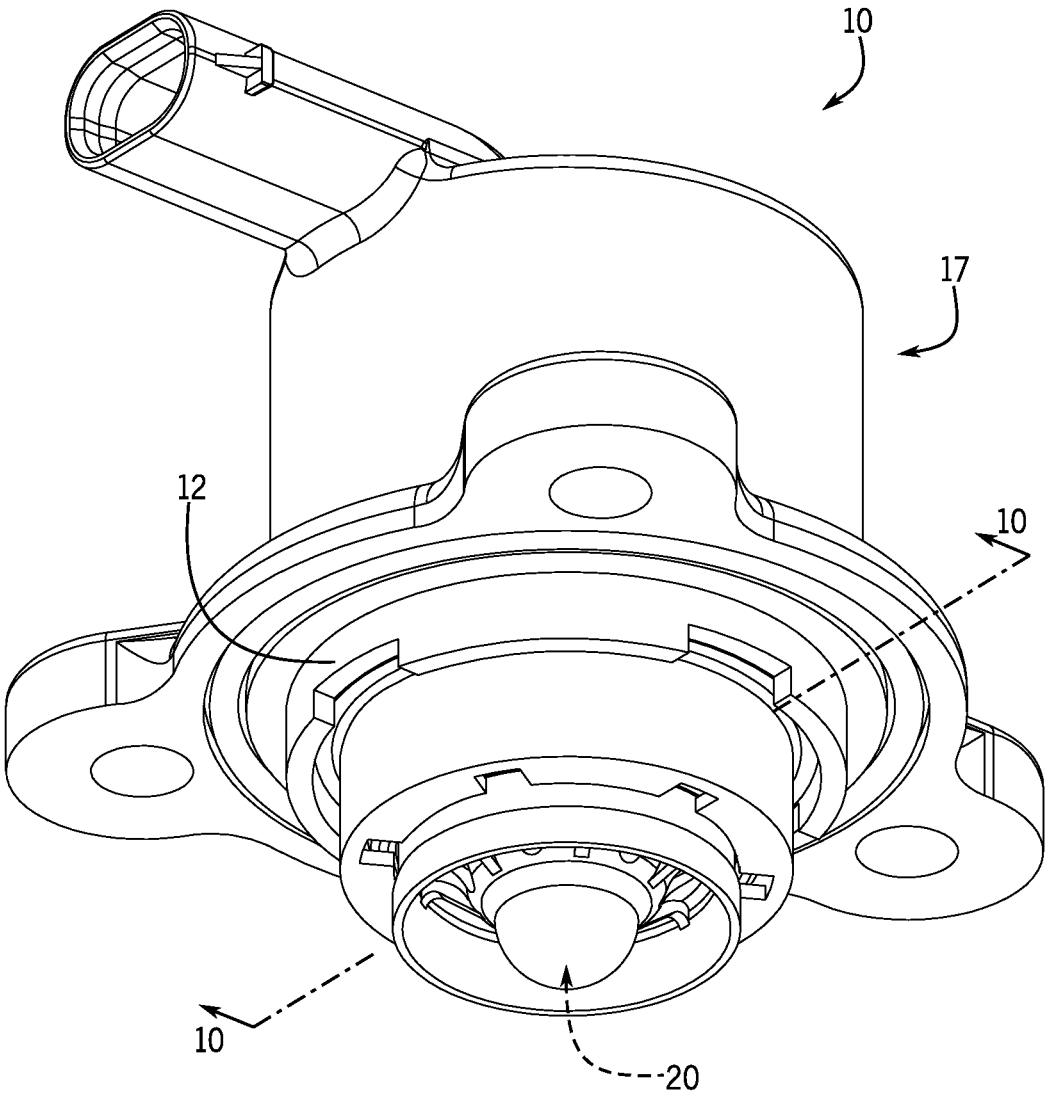
FIG. 9 is a bottom, front, right isometric view of an electromagnetic actuator according to one embodiment of the present invention.
Figure 10:
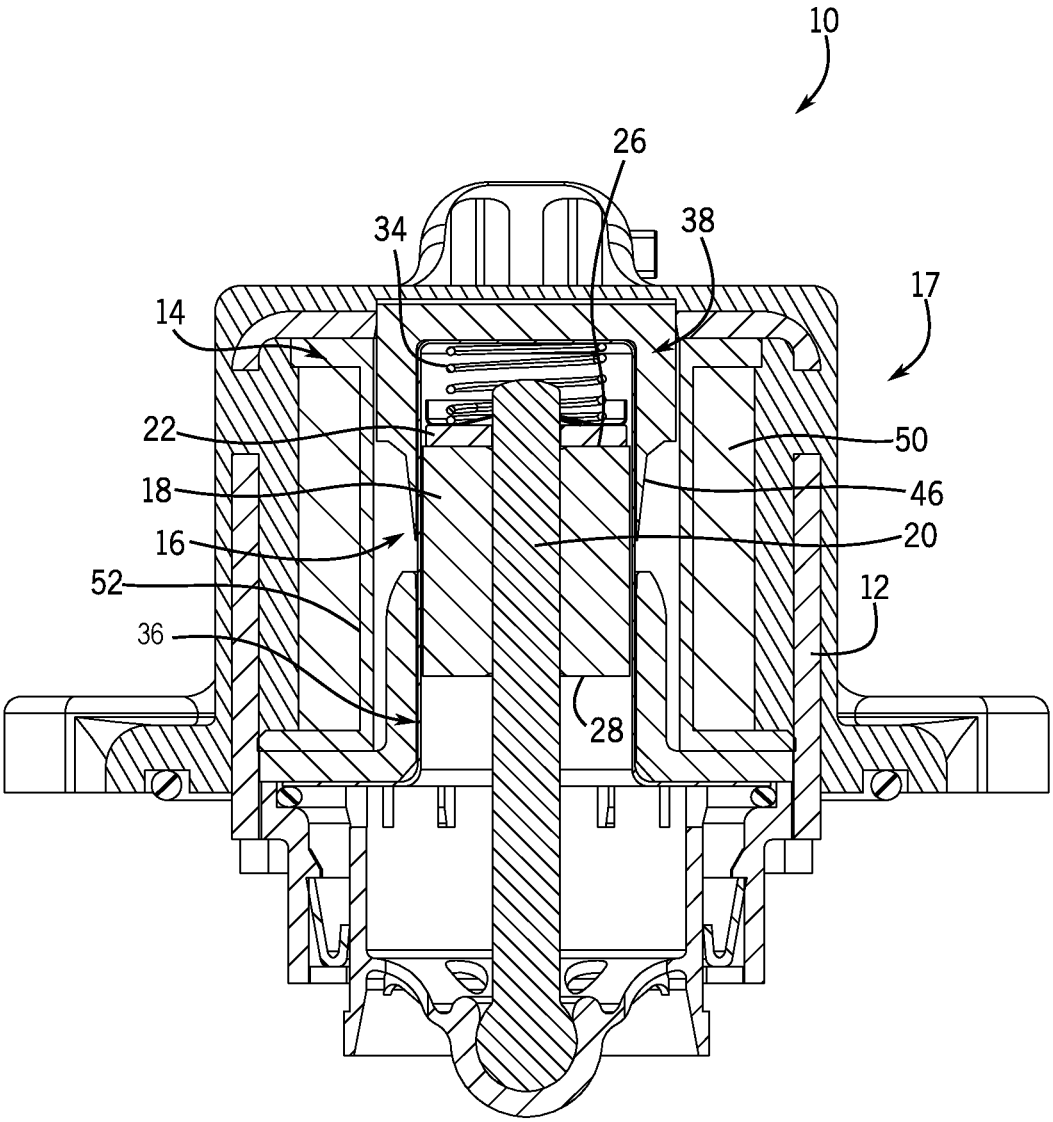
FIG. 10 is a cross-sectional view of the electromagnetic actuator of FIG. 9 taken along line 9-9.

As shown in FIGS. 9 and 10, a location of the permanent magnet 22 may be altered when compared to the push actuator of FIGS. 1-8. In the non-limiting example of FIGS. 9 and 10, the electromagnetic actuator 10 includes the permanent magnet 22 coupled to the first end 26 of the armature 18, as opposed to the second end 28 as shown in FIGS. 2-4. In addition, the spring 34 can be in engagement with the first end 26 of the armature 18 and can be configured to bias the armature opposite the direction of magnetic pull. This arrangement provides the same force output and reduced magnetic flux level advantages, as described above, but operates as a pull actuation as opposed to a push actuator.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. An electromagnetic actuator comprising:

a housing; and an armature assembly arranged within the housing and including an armature and a permanent magnet coupled to the armature, wherein the armature is movable between a first position and a second position, and wherein the permanent magnet defines an axial magnet thickness and the armature defines an axial armature thickness, and wherein a ratio of the axial armature thickness to the axial magnet thickness is greater than approximately three.

2. The electromagnetic actuator of claim 1, further including a pole piece arranged within the housing, wherein the pole piece includes a flange portion and a tapered surface.

3. The electromagnetic actuator of claim 2, wherein the flange portion extends radially outward and the tapered surface extends axially from the flange portion in a direction away from an end plate secured to the housing.

4. The electromagnetic actuator of claim 1, wherein the armature assembly is slidably received within a solenoid tube, and wherein the solenoid tube received within a housing bore defined by the housing.

5. The electromagnetic actuator of claim 4, further including a pole piece arranged within the housing, wherein the solenoid tube includes an armature platform which extends radially inward at an end of the solenoid tube adjacent to the pole piece.

6. The electromagnetic actuator of claim 1, wherein the permanent magnet is removably coupled to the armature.

7. The electromagnetic actuator of claim 1, wherein the permanent magnet is integrated into the armature.

8. The electromagnetic actuator of claim 1, wherein the permanent magnet is attached to the armature by an adhesive.

9. The electromagnetic actuator of claim 1, wherein the armature includes a plurality of bearing slots each configured to receive a bearing and arranged circumferentially around a periphery of the armature, the plurality of bearing slots each defining a radial recess in the armature that extends axially from a first end of the armature to a position between the first end and a second end of the armature.

10. The electromagnetic actuator of claim 1, further comprising a spring in engagement with the armature to retract the armature from the second position to the first position when the current is removed from a wire coil positioned around the armature assembly and arranged within the housing.

11. The electromagnetic actuator of claim 1, wherein the electromagnetic actuator is a proportional variable force solenoid.

12. The electromagnetic actuator of claim 1, further comprising a pole piece arranged within the housing, a wire coil positioned around the armature assembly and arranged within the housing, and an end plate secured to the housing to retain at least one of the pole piece, the wire coil, and the armature assembly within the housing.

13. An electromagnetic actuator comprising:

a housing;

an armature assembly arranged within the housing and including an armature and a permanent magnet coupled to the armature, wherein the armature is movable between a first position and a second position, wherein the armature defines an armature volume and the permanent magnet defines a permanent magnet volume, and wherein a ratio of the armature volume to the permanent magnet volume is greater than approximately three.

14. The electromagnetic actuator of claim 13, further including a pole piece arranged within the housing, wherein the pole piece includes a flange portion and a tapered surface.

15. The electromagnetic actuator of claim 13, wherein the permanent magnet is removably coupled to the armature.

16. The electromagnetic actuator of claim 13, wherein the permanent magnet is integrated into the armature.

17. The electromagnetic actuator of claim 13, wherein the armature includes a plurality of bearing slots each configured to receive a bearing and arranged circumferentially around a periphery of the armature, the plurality of bearing slots each defining a radial recess in the armature that extends axially from a first end of the armature to a position between the first end and a second end of the armature.

18. The electromagnetic actuator of claim 13, further comprising a spring in engagement with the armature to retract the armature from the second position to the first position when the current is removed from a wire coil positioned around the armature assembly and arranged within the housing.

19. The electromagnetic actuator of claim 13, wherein the electromagnetic actuator is a proportional variable force solenoid.

20. The electromagnetic actuator of claim 13, further comprising a pole piece arranged within the housing, a wire coil positioned around the armature assembly and arranged within the housing, and an end plate secured to the housing to retain at least one of the pole piece, the wire coil, and the armature assembly within the housing.

* * * * *